US011002237B2

(12) United States Patent
Mizui et al.

(10) Patent No.: US 11,002,237 B2
(45) Date of Patent: May 11, 2021

(54) GENERAL PURPOSE ENGINE

(71) Applicant: MIKUNI CORPORATION, Tokyo (JP)

(72) Inventors: Hiroshi Mizui, Kanagawa (JP); Osamu Miura, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 55 days.

(21) Appl. No.: 16/015,200

(22) Filed: Jun. 22, 2018

(65) Prior Publication Data

US 2018/0372051 A1 Dec. 27, 2018

(30) Foreign Application Priority Data

Jun. 22, 2017 (JP) ..... JP2017-122211

(51) Int. Cl.

| | |
|---|---|
| ***F02M 69/46*** | (2006.01) |
| ***F01P 5/04*** | (2006.01) |
| ***F01P 5/06*** | (2006.01) |
| ***F02M 69/04*** | (2006.01) |
| ***F02F 7/00*** | (2006.01) |
| ***F02D 41/30*** | (2006.01) |
| ***F02B 63/04*** | (2006.01) |

(52) U.S. Cl.

CPC ..... *F02M 69/46* (2013.01); *F01P 5/04* (2013.01); *F01P 5/06* (2013.01); *F02F 7/008* (2013.01); *F02M 69/042* (2013.01); *F01P 2025/08* (2013.01); *F02B 63/04* (2013.01); *F02D 41/30* (2013.01); *F02D 2200/021* (2013.01); *F02M 2200/248* (2013.01)

(58) Field of Classification Search

CPC ..... F02M 69/46; F02M 69/042; F02M 2200/248; F02F 7/008; F01P 5/06; F01P 5/04; F01P 2025/08; F02D 2200/021; F02D 41/30; F02B 63/04; F02B 77/089

See application file for complete search history.

(56) References Cited

U.S. PATENT DOCUMENTS 4,949,693 A * 8/1990 Sonoda ..... F02D 41/045 123/491
5,237,230 A * 8/1993 Sugiyama ..... F02N 11/04 290/46

(Continued)

FOREIGN PATENT DOCUMENTS

| | | |
|---|---|---|
| JP | H11200861 | 7/1999 |
| JP | 2004060567 | 2/2004 |

*Primary Examiner* — Joseph J Dallo
*Assistant Examiner* — Kurt Philip Liethen
(74) *Attorney, Agent, or Firm* — JCIPRNET

(57) ABSTRACT

To secure detection accuracy of a temperature sensor in a general purpose engine. A general purpose engine includes an engine main body (21), an output shaft (22) that outputs a rotation force of the engine main body, a cooling fan (40) that is rotated and driven by the output shaft, a cooling cover (50) that is fixed to the engine main body to define a cooling air passage (CP) which guides cooling air generated by the cooling fan along an exterior wall (21*e*) of the engine main body, and a temperature sensor (60) that is fixed to the engine main body in a region away from the cooling air passage (CP). Accordingly, it is possible to measure a temperature of the engine main body with high accuracy and perform electronic control of fuel injection with high accuracy.

9 Claims, 7 Drawing Sheets

(56) References Cited

U.S. PATENT DOCUMENTS

| | | | | |
|---|---|---|---|---|
| 5,977,667 | A * | 11/1999 | Hirose | F02B 63/04 290/1 B |
| 6,489,690 | B1 * | 12/2002 | Hatsugai | F02B 63/04 123/2 |
| 7,743,739 | B2 * | 6/2010 | Kochi | F02B 63/04 123/2 |
| 9,068,528 | B2 * | 6/2015 | Sanbyakuda | F01L 1/053 |
| 10,030,609 | B2 * | 7/2018 | Markoski | F02M 31/005 |
| 2016/0281597 | A1 * | 9/2016 | Kase | F02N 3/02 |
| 2016/0294255 | A1 * | 10/2016 | Schmit | F02B 63/04 |
| 2016/0298552 | A1 * | 10/2016 | Yoshizaki | G01K 1/16 |
| 2018/0016964 | A1 * | 1/2018 | Ichihashi | F02B 75/16 |

* cited by examiner

GENERAL PURPOSE ENGINE

CROSS-REFERENCE TO RELATED APPLICATION

This application claims the priority of Japan patent application serial no. 2017-122211, filed on Jun. 22, 2017. The entirety of the above-mentioned patent application is hereby incorporated by reference herein and made a part of this specification.

BACKGROUND

Technical Field

The disclosure relates to a general purpose engine including a cooling fan for allowing cooling air to flow around an engine main body and a cooling cover.

Description of Related Art

In the related art, an engine generator including a sound insulation case covering the whole thereof, an engine disposed in the case, a generator and cooling fan that are connected to an output shaft of the engine, a fan cover surrounding the cooling fan and generator in the case, a cooling ventilation shroud surrounding the engine, a fuel tank, and a control unit configured to control the generator is known (for example, refer to Patent Literature 1).

In addition, an engine generator including a sound insulation case covering the whole thereof, an engine disposed in the case, a generator and cooling fan that are connected to an output shaft of the engine, a fan cover surrounding the cooling fan and generator in the case, a crankcase cover and muffler cover surrounding the engine, a fuel tank, a cell motor for starting connected to the engine, a battery, and a controller configured to control the generator and the like is known (for example, refer to Patent Literature 2).

In these engine generators, the engine includes a carburetor in an intake system, and fuel sucked into the carburetor is mixed with air, and is guided into a combustion chamber, and combusted.

Incidentally, in the above engine generators, it is necessary to provide a temperature sensor in order to detect the temperature of an engine main body.

On the other hand, in the engine generators of the related art, in consideration of improvement in fuel efficiency, purification of exhaust gas, and the like, application of a fuel injection system according to electronic control has been studied.

In this system, the temperature of the engine main body and the like are applied as information for controlling fuel injection.

[Patent Document 1] Japanese Unexamined Patent Application Publication No. H11-200861

[Patent Literature 2] Japanese Unexamined Patent Application Publication No. 2004-60567

SUMMARY

The disclosure provides a general purpose engine that can measure a temperature of an engine main body with high accuracy and perform electronic control of fuel injection and the like.

A general purpose engine of the disclosure has a configuration that includes an engine main body; an output shaft that outputs a rotation force of the engine main body; a cooling fan that is rotated and driven by the output shaft; a cooling cover that is fixed to the engine main body to define a cooling air passage which guides cooling air generated by the cooling fan along an exterior wall of the engine main body; and a temperature sensor that is fixed to the engine main body in a region away from the cooling air passage.

In the general purpose engine of the above configuration, a configuration in which the engine main body includes a boss part that projects from an exterior wall thereof, the cooling cover is fastened by a screw that is screwed into a screw hole of the boss part, and the temperature sensor is fastened to the boss part together with the cooling cover by the screw may be used.

In the general purpose engine of the above configuration, a configuration in which the engine main body includes a boss part that projects from an exterior wall thereof, and the temperature sensor includes a male screw that is screwed into a screw hole of the boss part and an enlarged diameter part that is formed to have a larger diameter than the male screw, and is fastened to the boss part by clamping the cooling cover with the enlarged diameter part may be used.

In the general purpose engine of the above configuration, a configuration in which the cooling cover is made of a resin material and includes a metallic collar that defines a through-hole, and the temperature sensor comes in contact with the collar and is fastened to the boss part may be used.

In the general purpose engine of the above configuration, a configuration in which the boss part is integrally formed with the engine main body or formed separately and then connected to the engine main body may be used.

In the general purpose engine of the above configuration, a configuration in which the engine includes an electronic control injector configured to inject a fuel toward an intake passage, and the temperature sensor is fixed to the engine main body in the vicinity of the injector may be used.

In the general purpose engine of the above configuration, a configuration in which an outer case covering the whole thereof is provided outside the cooling cover, and the temperature sensor is disposed in a region covered with the outer case may be used.

The general purpose engine of the above configuration may further include a power generation unit configured to generate power according to rotation of the output shaft.

According to the general purpose engine of the above configuration, the temperature sensor can measure a temperature of an engine main body with high accuracy without being influenced by cooling air and it is possible to obtain a general purpose engine that can perform electronic control of fuel injection.

DESCRIPTION OF THE EMBODIMENTS

Figure 1:
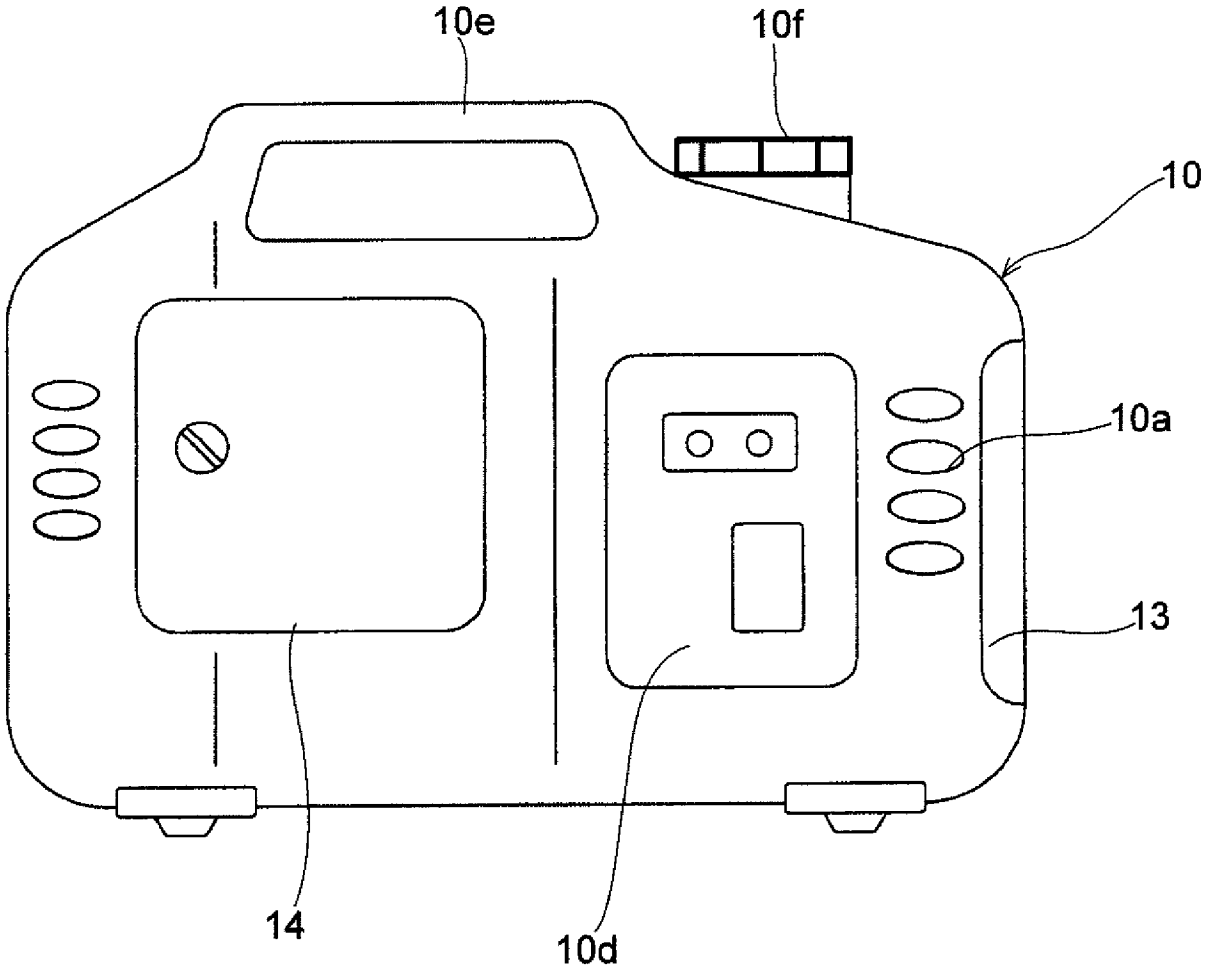
FIG. 1 is a side view showing a general purpose engine according to an embodiment of the invention.

A general purpose engine according to an embodiment of the invention will be described below with reference to FIG. 1 to FIG. 3 in the appended claims.

A general purpose engine according to the embodiment includes an outer case 10, an engine unit 20, a fuel tank 30, a cooling fan 40, a cooling cover 50, a temperature sensor 60, a power generation unit 70, a controller 80, and a recoil starter 90.

The outer case 10 is made of a resin material, a metal material, or the like, and is composed of a first case 11 and a second case 12 that are fastened to each other.

The outer case 10 is formed to cover all of the engine unit 20 and accessory parts in order to secure sound insulation and safety, and part protection functions.

The outer case 10 includes a plurality of air intake ports 10*a* on both sides, a plurality of air discharge ports 10*b* on the rear surface and an opening 10*c* through which an exhaust pipe 26 of the engine unit 20 passes, and an operation panel 13 on the front surface.

In addition, the outer case 10 includes a detachable maintenance cover 14 and a rectangular recess 10*d* on one side.

In the rectangular recess 10*d*, a switch, an adjustment lever, a starting grip connected to the recoil starter 90, and the like are disposed.

In addition, the outer case 10 includes a gripping part 10*e* and an oil supply cap 10*f* on the upper side.

The air intake port 10*a* is formed such that air is sucked as cooling air from the outside of the outer case 10 to the inside of the cooling cover 50 when the cooling fan 40 is operated.

The air discharge port 10*b* is formed to discharge air as cooling air flowing along an exterior wall 21*e* of the engine unit 20 into outside of the outer case 10.

The operation panel 13 is applied when generated power is used, and includes an outlet for connecting an external connection plug, various switches, and the like.

The engine unit 20 is a 4-cycle internal combustion engine, and is disposed inside the outer case 10, and includes an engine main body 21, an output shaft 22, an intake pipe 23, an air cleaner 24, an injector 25 for fuel injection, an ignition plug (not shown), the exhaust pipe 26, and a muffler 27 disposed on the way of the exhaust pipe 26.

The engine main body 21 includes a cylinder block 21*a*, an oil pan connected to a lower part of the cylinder block 21*a*, a cylinder head 21*b* connected to the upper side of the cylinder block 21*a*, and a cylinder head cover 21*c* connected to the upper side of the cylinder head 21*b*.

The cylinder block 21*a* is made of an iron or aluminum material, and houses a rotatable crankshaft, a reciprocating piston, and a connecting rod that connects the piston to the crankshaft.

The cylinder head 21*b* is made of an aluminum material, defines a combustion chamber, an intake port that forms a part of an intake passage, and an exhaust port that forms a part of an exhaust passage, and is formed to fix the injector 25 and the ignition plug and hold a valve system.

The cylinder head cover 21*c* is made of an aluminum material or a metal plate, and is formed to cover the valve system and the ignition plug.

In addition, the engine main body 21 includes a plurality of boss parts 21*f* that are formed to project from the exterior wall 21*e*.

Figure 3:
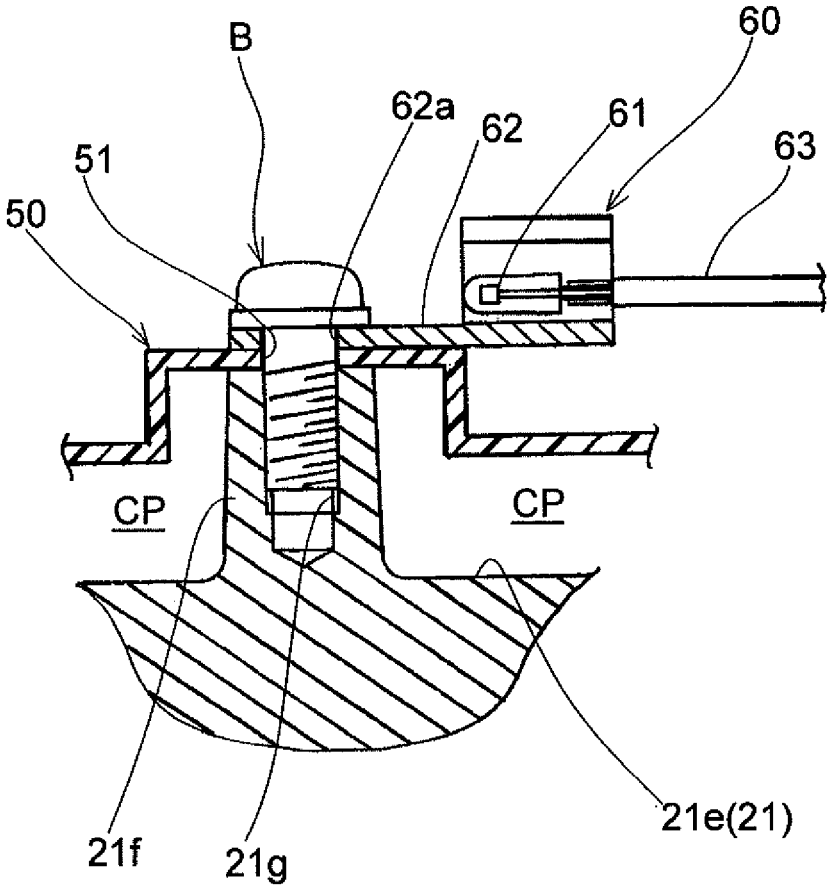
FIG. 3 is a partial cross-sectional view showing a mounting structure of a temperature sensor according to an embodiment in the general purpose engine shown in FIG. 1.

As shown in FIG. 3, the boss part 21*f* includes a screw hole 21*g* for screwing a screw B so that the cooling cover 50 is fixed to the engine main body 21.

Here, the boss parts 21*f* may be formed in all of the cylinder block 21*a*, the cylinder head 21*b*, and the cylinder head cover 21*c*, or may be formed only in the cylinder block 21*a*.

The output shaft 22 is integrally formed coaxially with respect to the crankshaft so that it projects from the engine main body 21, and includes a connecting part that connects rotors of the cooling fan 40 and the power generation unit 70.

The intake pipe 23 is formed to define an intake passage 23*a* that communicates with an intake port of the cylinder head 21*b* and is fixed to the cylinder head 21*b*.

The air cleaner 24 is connected to the upstream side of the intake pipe 23 and is disposed to suck in air introduced into the outer case 10.

The injector 25 is formed to inject a desired fuel when it is electromagnetically driven on the basis of a predetermined control signal output from the controller 80, and thus its valve opening time and its valve opening period are appropriately controlled.

Thus, the injector 25 is fixed to the cylinder head 21*b* so that a fuel is injected toward the intake port of the cylinder head 21*b*.

The exhaust pipe 26 defines an exhaust passage that communicates with an exhaust port of the cylinder head 21*b*, and is formed to hold the muffler 27 midway and is fixed to the cylinder head 21*b*.

Thus, the exhaust pipe 26 is disposed so that its end is exposed from the opening 10*c* of the outer case 10.

The fuel tank 30 is disposed inside the outer case 10, stores fuel injected from the oil supply cap 10*f*, and is configured to introduce the fuel to the injector 25 through a supply pipe 31 using a pressure pump that is built therein or adjacent thereto.

The cooling fan 40 is connected to a connecting part of the output shaft 22 so that it integrally rotates with the output shaft 22.

Thus, when the cooling fan 40 rotates, air introduced from the outside of the outer case 10 is introduced into a cooling air passage CP defined between the cooling cover 50 and the exterior wall 21*e* of the engine main body 21.

The cooling cover 50 is made of a metal plate such as stainless steel or a heat-resistant resin material, and is formed to cover the engine main body 21, the exhaust pipe 26, the power generation unit 70, the cooling fan 40, and the recoil starter 90.

In addition, the cooling cover 50 includes a through-hole 51 through which the screw B passes, an air inlet 52 for sucking in air in front of the cooling fan 40, and an air outlet 53 in the vicinity of the air discharge port 10*b*.

Thus, the cooling cover 50 is disposed so that it defines the cooling air passage CP as a predetermined gap between it and the exterior wall 21*e* of the engine main body 21, and is fixed to the engine main body 21 when the screw B is screwed into the screw hole 21*g* of the boss part 21*f* through the through-hole 51.

The cooling air passage CP guides cooling air generated from air introduced from the air inlet 52 to the cooling fan 40 along the exterior wall 21*e* of the engine main body 21 and introduces the air to the air outlet 53 that communicates with the air discharge port 10*b* of the outer case 10.

In this manner, when cooling air flows through the cooling air passage CP, air cooling performance of the engine unit 20 can be improved and it is possible to prevent the engine unit 20 reaching a high temperature exceeding a predetermined temperature.

In addition, since the cooling cover 50 surrounds the engine main body 21, it is possible to obtain sound insulation or a sound insulation effect.

As shown in FIG. 3, the temperature sensor 60 includes a thermistor 61 sealed with a sealing material such as a fluororesin or an epoxy resin, a connecting part 62 having a through-hole 62*a* through which the screw B passes, and a wiring 63 connected to the thermistor 61.

The thermistor 61 is connected to the connecting part 62 through a sealing material and is configured to detect heat that is transmitted from the connecting part 62.

The connecting part 62 is formed of, for example, a thin plate material made of a metal having favorable thermal conductivity, and is, formed of, for example, a thin plate material plated with brass.

Figure 2:
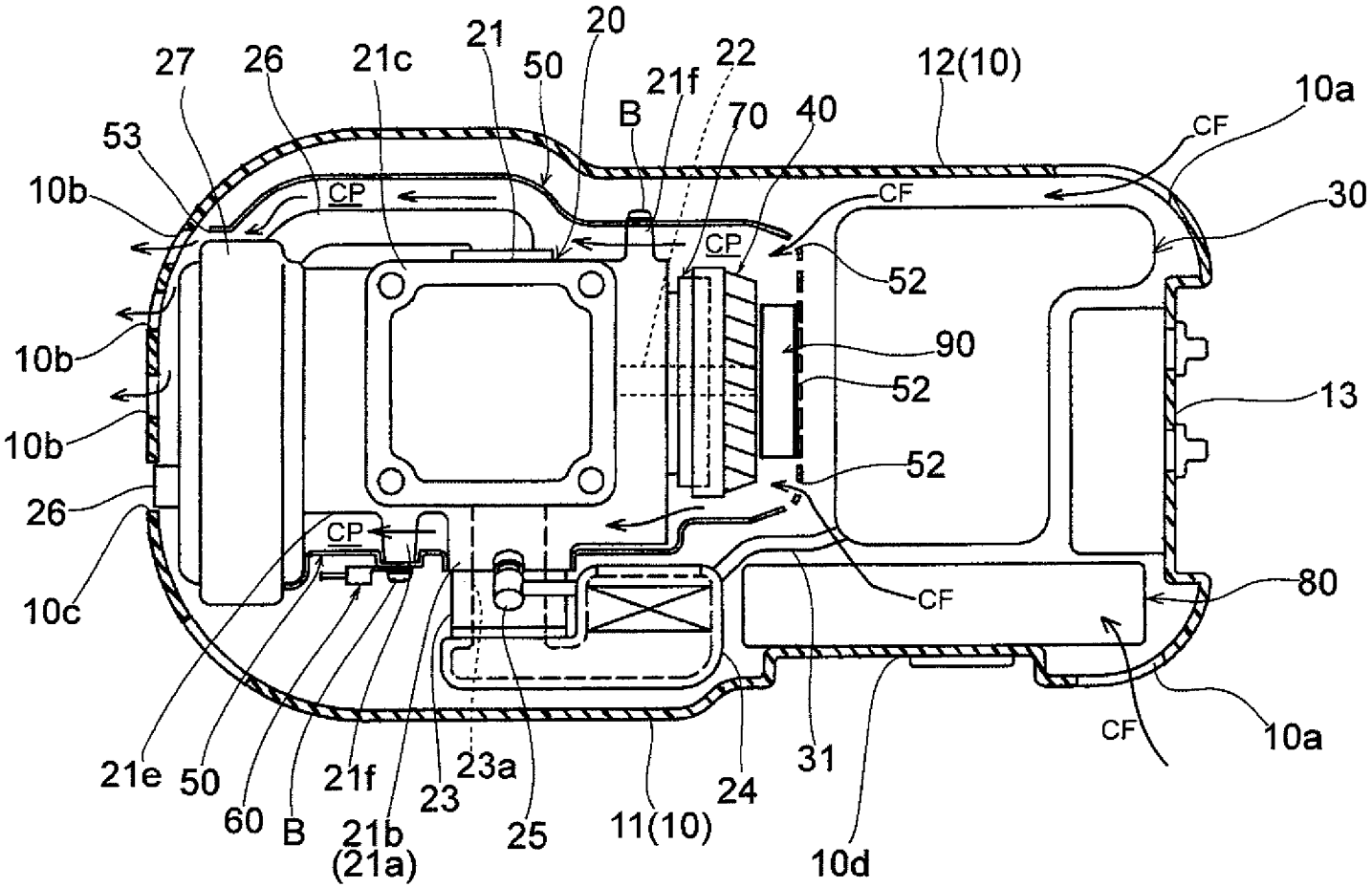
FIG. 2 is a plan view showing a state in which an outer case and a cooling cover are cut along a horizontal plane in the general purpose engine shown in FIG. 1.

Thus, as shown in FIG. 2, in a region on the side opposite to the side in which the air outlet 53 is provided with respect to the engine main body 21, the temperature sensor 60 is fastened to the boss part 21*f* provided in the cylinder block 21*a* of the engine main body 21 positioned in the vicinity of the injector 25 by the screw B and is fixed to the engine main body 21.

Here, the position of the temperature sensor 60 is not limited to the vicinity of the injector 25. Any position in the vicinities of the air cleaner 24, the muffler 27, and the air outlet 53 may be selected, and the temperature sensor 60 may be fixed to the cylinder head 21*b* that forms a part of the engine main body 21 or the boss part 21*f* provided in the cylinder head cover 21*c* without limitation to the cylinder block 21*a* that forms a part of the engine main body 21.

That is, the temperature sensor 60 detects a temperature of the engine main body 21 through the boss part 21*f* and the screw B.

Therefore, the screw B made of a metal material having favorable thermal conductivity, for example, a material such as iron, brass, and aluminum, is preferable.

A detection value of the temperature sensor 60 is applied as a part of input information when fuel injection by the injector 25 is electronically controlled.

Here, as shown in FIG. 2 and FIG. 3, the temperature sensor 60 is disposed outside the cooling cover 50 and inside the outer case 10, and is fastened to the boss part 21*f* together with the cooling cover 50 by the screw B that fastens the cooling cover 50, and is fixed to the engine main body 21.

That is, since the temperature sensor 60 is disposed in a region away from the cooling air passage CP, it is not directly exposed to cooling air that flows through the cooling air passage CP.

Therefore, the temperature sensor 60 can detect a temperature of the engine main body 21 with high accuracy without being influenced by cooling air.

In addition, it is not necessary to select an expensive material having high heat resistance as a sealing material that seals the thermistor 61 of the temperature sensor 60.

In addition, since the temperature sensor 60 is fixed to the engine main body 21 by screw fastening by commonly using the screw B that fastens the cooling cover 50, a dedicated screw is not necessary. Therefore, it is possible to reduce costs without increasing the number of parts.

In addition, since the temperature sensor 60 is fixed at the boss part 21*f* that is positioned in the vicinity of the injector 25, it is possible to detect a temperature of the engine main body 21 with high accuracy.

Further, since the temperature sensor 60 is disposed in a region covered by the outer case 10, it is possible to prevent interference with other external members or operators. Therefore, damage and the like can be prevented.

The power generation unit 70 is disposed in a region surrounded by the cooling cover 50, and includes a rotor that is connected to a connecting part of the output shaft 22 and has a plurality of magnets, and a stator including a core fixed to the cylinder block 21*a* and a coil wound around the core.

Thus, the power generation unit 70 generates power when the rotor rotates together with the output shaft 22, and generates power as a direct current.

In addition, the rotor of the power generation unit 70 also serves as a flywheel connected to the crankshaft of the engine unit 20.

In addition, power generated by the power generation unit 70 may be formed so that it is appropriately controlled by a control unit included in the controller 80. For example, a configuration in which the control unit includes an inverter, and control is performed such that the inverter converts a direct current into an alternating current may be used.

In addition, power generated from the power generation unit 70 is supplied to an external electronic device through an outlet of the operation panel 13.

The controller 80 is disposed inside the outer case 10 and outside the cooling cover 50, and includes a fuel injection control unit configured to control fuel injection and a power generation control unit configured to control the power generation unit 70.

The fuel injection control unit includes a wiring board that electrically connects the injector 25 and the temperature sensor 60.

In addition, as a system configured to control fuel injection, as necessary, other sensors such as an intake air temperature sensor and an intake air flow rate sensor may be applied.

The recoil starter 90 is disposed adjacent to the cooling fan 40 in a region surrounded by the cooling cover 50.

The recoil starter 90 includes a recoil pulley that is rotatably supported on an inner wall of the cooling cover 50 coaxially with the output shaft 22, a cable wound on the recoil pulley, a starting grip connected to the cable, and an engagement claw that is detachably engaged with a part of the cooling fan 40.

Thus, when an operator pulls the starting grip at the time of starting, the engagement claw is engaged with the cooling fan 40, and rotates the crankshaft through the cooling fan 40.

Next, operations of the general purpose engine will be described.

First, the output shaft 22 (crankshaft) is forcibly rotated by the recoil starter 90 and the engine is started.

Here, using power generated by the power generation unit 70 that rotates at the same time as the output shaft 22, the controller 80 is operated and the injector 25 is driven and controlled.

In addition, a battery may be included as a separate power supply.

When the engine starts, a rotational speed of the engine is adjusted by a throttle lever or the like. Therefore, the power generation unit 70 generates power and the cooling fan 40 rotates and generates cooling air.

When the cooling fan 40 rotates, as indicated by an arrow CF in FIG. 2, air is sucked to the inside from the outside of the outer case 10 through the air intake port 10*a*.

Next, the sucked air passes through the air inlet 52 of the cooling cover 50 and is introduced into the cooling air passage CP formed between the cooling cover 50 and the exterior wall 21*e* of the engine main body 21.

The air as cooling air introduced into the cooling air passage CP is guided along the exterior wall 21*e* of the engine main body 21 and reaches the air outlet 53, and is discharged from the air discharge port 10*b* of the outer case 10 to the outside. According to the flow of the cooling air, the engine main body 21 is cooled by air.

On the other hand, power generated by the power generation unit 70 is supplied to an external electronic device by connecting a plug to an outlet of the operation panel 13.

Incidentally, the temperature sensor 60 detects a temperature of the engine main body 21. Then, the detected temperature information is sent to the controller 80, and is used as input information when fuel injection by the injector 25 is controlled.

Here, since the temperature sensor 60 is fixed to the engine main body 21 in a region away from the cooling air passage CP, it is not directly exposed to cooling air that flows through the cooling air passage CP and is not influenced by cooling air. Therefore, a temperature of the engine main body 21 is detected with high accuracy.

As described above, when the temperature sensor 60 is disposed and mounted, it is possible to measure a temperature of the engine main body 21 with high accuracy and it is possible to perform electronic control of fuel injection with high accuracy.

Therefore, it is possible to improve fuel efficiency, purify exhaust gas, and reduce costs according to shared parts.

Figure 4:
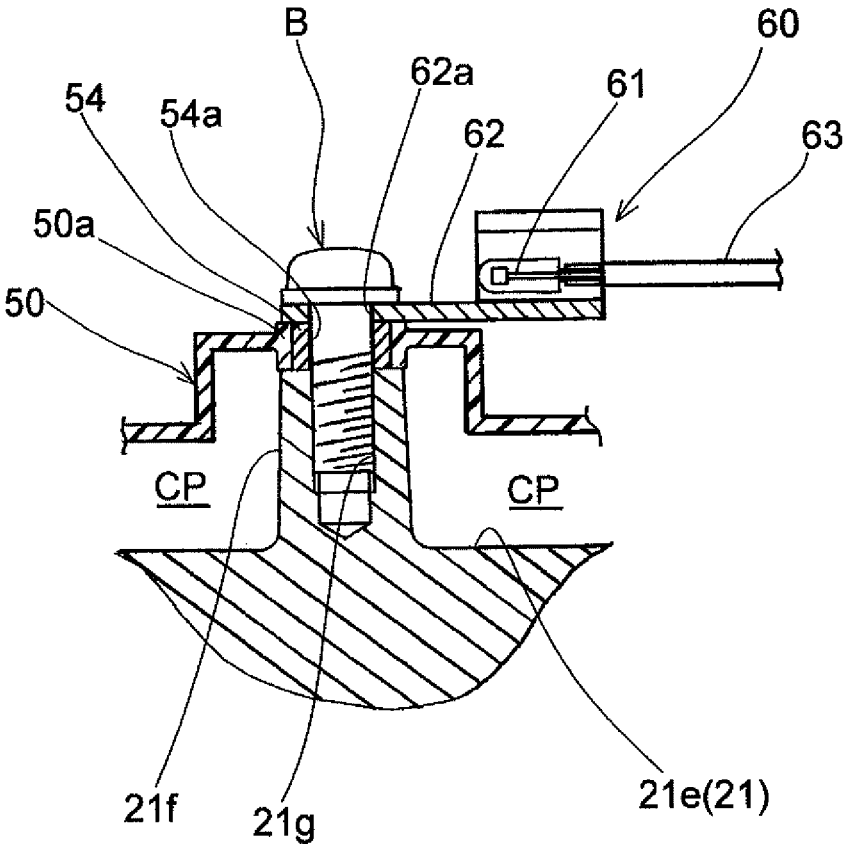
FIG. 4 is a partial cross-sectional view showing another embodiment of the mounting structure of the temperature sensor.

FIG. 4 shows another embodiment of the mounting structure of the temperature sensor 60.

In this embodiment, the cooling cover 50 is made of a resin material, and a mounting region 50*a* thereof that is brought into contact with the boss part 21*f* is formed to be thick. Thus, a cylindrical metallic collar 54 is incorporated in the mounting region 50*a*.

Here, the collar 54 defines a through-hole 54*a* through which the screw B passes and is formed to have substantially the same height as the mounting region 50*a* so that it comes in contact with the boss part 21*f* and the connecting part 62 of the temperature sensor 60.

Thus, while the mounting region 50*a* of the cooling cover 50 and the collar 54 are in contact with the boss part 21*f*, the temperature sensor 60 is disposed so that the connecting part 62 comes in contact with the collar 54 from the outside of the cooling cover 50 and is fastened by the screw B.

In this embodiment also, the temperature sensor 60 is disposed outside the cooling cover 50 and inside the outer case 10, is fastened to the boss part 21*f* together with the cooling cover 50 by the screw B that fastens the cooling cover 50 and is fixed to the engine main body 21.

That is, since the temperature sensor 60 is disposed in a region away from the cooling air passage CP, it is not directly exposed to cooling air that flows through the cooling air passage CP. Therefore, the temperature sensor 60 can detect a temperature of the engine main body 21 with high accuracy without being influenced by cooling air.

Figure 5:
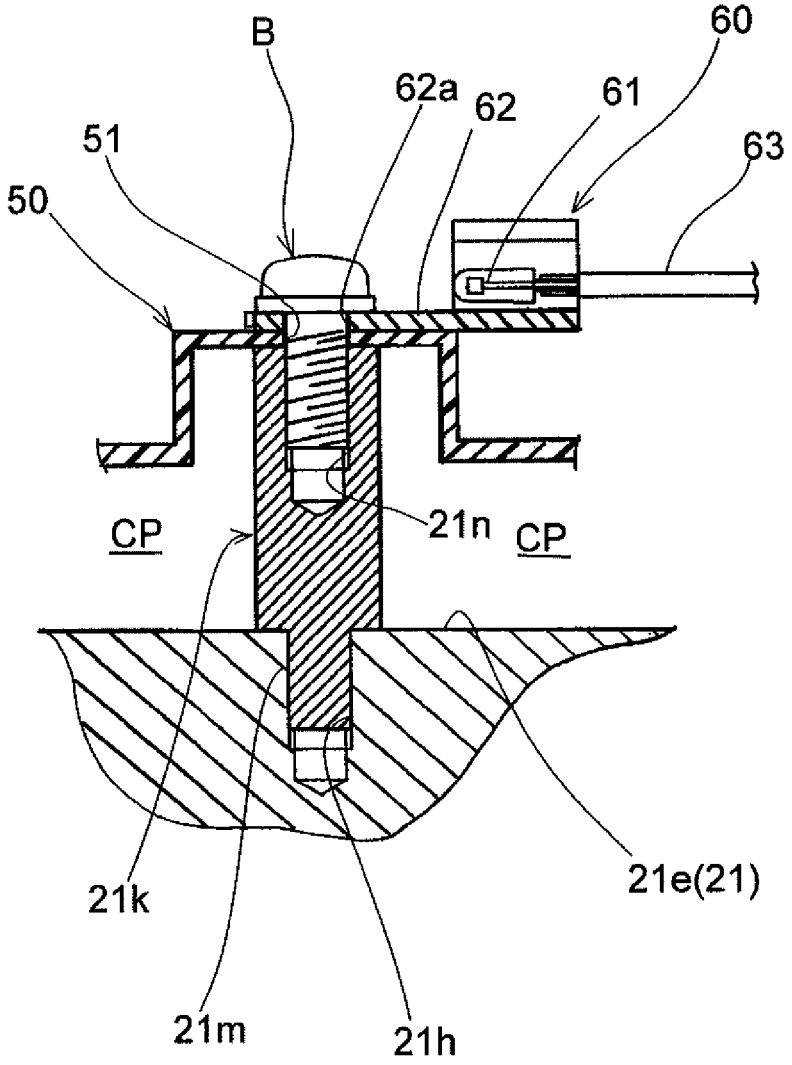
FIG. 5 is a partial cross-sectional view showing still another embodiment of the mounting structure of the temperature sensor.

FIG. 5 shows still another embodiment of the mounting structure of the temperature sensor 60.

In this embodiment, a screw hole 21*h* is provided in the engine main body 21. In addition, a boss member 21*k* that is formed separately from the engine main body 21 is used.

The boss member 21*k* has a cylindrical shape with a predetermined length, and includes a male screw 21*m* to be screwed into the screw hole 21*h* and a screw hole 21*n* into which the screw B is screwed.

The boss member 21*k* is made of the same iron or aluminum material as the engine main body 21 or a metal material such as brass having favorable thermal conductivity.

While the male screw 21*m* is screwed into the screw hole 21*h*, the boss member 21*k* functions similarly to the boss part 21*f* that is integrally formed with the engine main body 21.

Upon assembly, first, the boss member 21*k* is screwed into the screw hole 21*h* and is firmly fixed to the engine main body 21.

Next, the temperature sensor 60 is brought close to the outside of the cooling cover 50 and the connecting part 62 is disposed so that it comes in contact with the cooling cover 50, and is fastened by the screw B.

In this embodiment also, the temperature sensor 60 is disposed outside the cooling cover 50 and inside the outer case 10, and is fastened to the boss member 21*k* as a boss part together with the cooling cover 50 by the screw B that fastens the cooling cover 50 and is fixed at the engine main body 21.

That is, since the temperature sensor 60 is disposed in a region away from the cooling air passage CP, it is not directly exposed to cooling air that flows through the cooling air passage CP. Therefore, the temperature sensor 60 can detect a temperature of the engine main body 21 with high accuracy without being influenced by cooling air.

Figure 6:
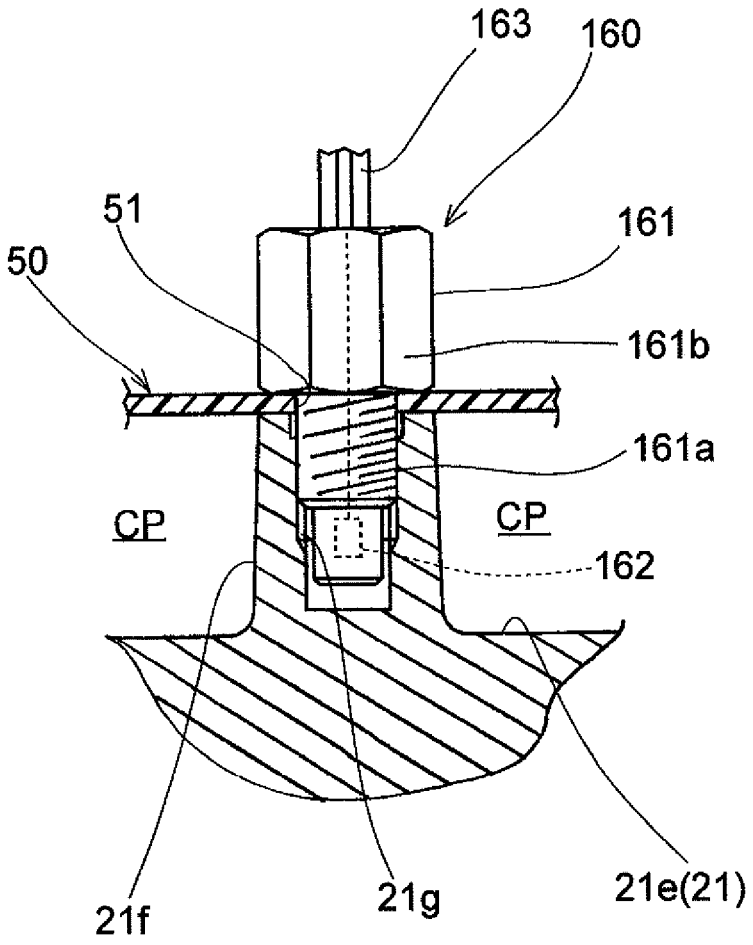
FIG. 6 is a partial cross-sectional view showing a mounting structure of a temperature sensor according to another embodiment.

FIG. 6 shows a case in which a temperature sensor 160 according to another embodiment is used in place of the temperature sensor 60.

In this embodiment, the temperature sensor 160 includes a protective pipe 161 made of a metal material, a thermistor 162 sealed with a sealing material such as a fluororesin or an epoxy resin in the protective pipe 161, and a wiring 163 connected to the thermistor 162.

The thermistor 162 is connected to the protective pipe 161 through a sealing resin and detects heat that is transmitted from the protective pipe 161.

The protective pipe 161 is formed by cutting a metal material having favorable thermal conductivity, for example, a material such as brass, and includes a male screw 161*a* that is screwed into the screw hole 21*g* of the boss part 21*f* and an enlarged diameter part 161*b* that is formed to have a larger diameter than the male screw 161*a* and has substantially a hexagonal columnar shape.

Thus, the temperature sensor 160 is brought close to the outside of the cooling cover 50 and the male screw 161*a* passes through the through-hole 51 and is screwed into the boss part 21*f* (the screw hole 21*g*) of the engine main body 21.

Therefore, the temperature sensor 160 is fixed to the engine main body 21 while the cooling cover 50 is clamped between the enlarged diameter part 161*b* and the boss part 21*f* in cooperation with each other.

In this manner, since the temperature sensor 160 itself is screwed and fixed, in a region in which the temperature sensor 160 is mounted, the screw B used in the above embodiment is not necessary.

In this embodiment also, the temperature sensor 160 is fixed to the engine main body 21 when the protective pipe 161 into which the thermistor 162 is built is exposed to the outside of the cooling cover 50 and is disposed in a region covered with a wall part of the boss part 21*f* and inside the outer case 10, and the cooling cover 50 is clamped between the protective pipe 161 and the boss part 21*f* in cooperation with each other.

That is, since the temperature sensor 160 is disposed in a region away from the cooling air passage CP, it is not directly exposed to cooling air that flows through the cooling air passage CP. Therefore, the temperature sensor 160 can detect a temperature of the engine main body 21 with high accuracy without being influenced by cooling air.

Figure 7:
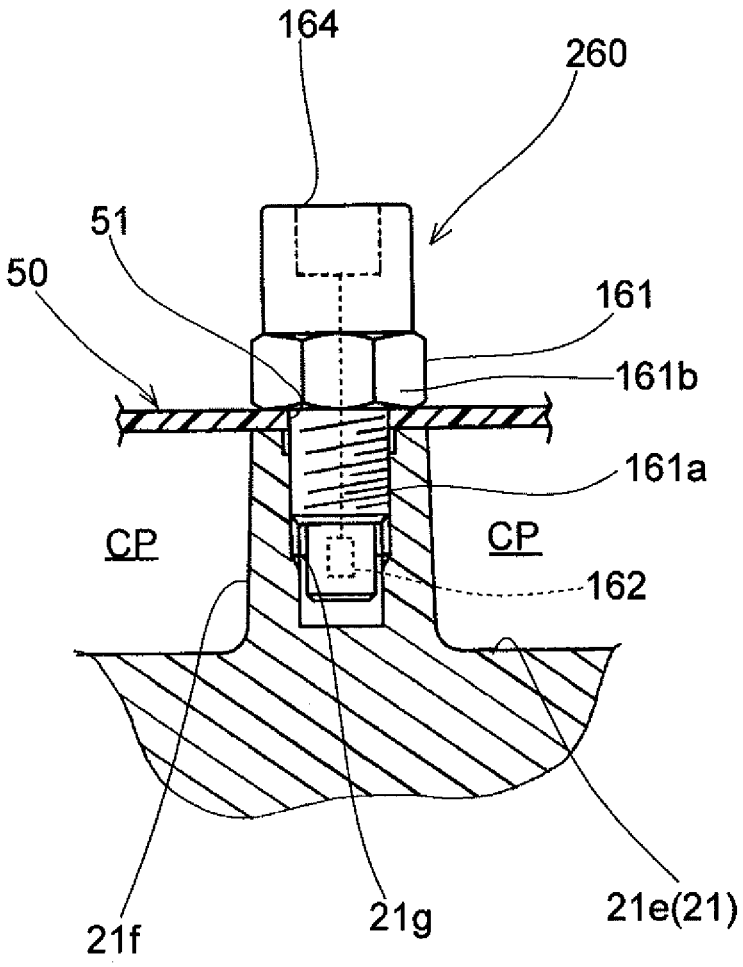
FIG. 7 is a partial cross-sectional view showing a mounting structure of a temperature sensor according to still another embodiment.

FIG. 7 shows a case in which a temperature sensor 260 according to another embodiment is used in place of the temperature sensor 160. In addition, components the same as in the embodiment shown in FIG. 6 will be denoted with the same reference numerals and descriptions thereof will be omitted.

In this embodiment, the temperature sensor 260 includes the protective pipe 161 and the thermistor 162 and includes a female connector 164 that connects a wiring in place of the above wiring 163.

In the same manner as described above, the thermistor 162 is connected to the protective pipe 161 through a sealing resin, and detects heat that is transmitted from the protective pipe 161.

The female connector 164 that can be electrically connected to a male connector of a wiring led from the controller 80 is formed.

In this embodiment also, the temperature sensor 260 is fixed to the engine main body 21 when the protective pipe 161 into which the thermistor 162 is built is exposed to the outside of the cooling cover 50, and is disposed in a region covered with the wall part of the boss part 21*f* and inside the outer case 10, and the cooling cover 50 is clamped between the protective pipe 161 and the boss part 21*f* in cooperation with each other.

That is, since the temperature sensor 260 is disposed in a region away from the cooling air passage CP, it is not directly exposed to cooling air that flows through the cooling air passage CP. Therefore, the temperature sensor 260 can detect a temperature of the engine main body 21 with high accuracy without being influenced by cooling air.

While a configuration including the power generation unit 70 as a general purpose engine has been shown in the above embodiment, the disclosure is not limited thereto. The disclosure can be applied to a general purpose engine in which an output shaft is formed so that a power generation unit can be connected to the output shaft 22 from the outside, and power can be generated by connecting a power generation unit that is provided separately from the output shaft.

While a configuration including the injector 25 as a general purpose engine has been shown in the above embodiment, the disclosure is not limited thereto. In a configuration including a conventional carburetor as a fuel supply system, when it is necessary to detect temperature information of the engine main body, the disclosure can be applied to a disposition of the temperature sensor and the mounting structure.

While a configuration including the outer case 10 as a general purpose engine has been shown in the above embodiment, the disclosure is not limited thereto. The disclosure can be applied to a general purpose engine of which the outer case is removed.

While a case in which a general purpose engine is applied to a generator has been shown in the above embodiment, the disclosure is not limited thereto. The disclosure can be applied to air-cooled engines mounted on two-wheeled vehicles, other vehicles, and the like.

In the above embodiment, as a method of fixing the temperature sensors 60, 160, and 260 to the engine main body 21, a fixing method in which a sensor is screw-fastened to the boss part 21*f* using the screw B or the male screw 161*a* of the temperature sensors 160 and 260 is directly screwed into the boss part 21*f* has been shown. However, the disclosure is not limited thereto, and other methods may be used for fixing.

As described above, the general purpose engine of the disclosure can measure a temperature of the engine main body with high accuracy, can perform electronic control of fuel injection with high accuracy, and can improve fuel efficiency, purify exhaust gas, and reduce costs according to shared parts. Therefore, the general purpose engine of the disclosure can be applied for power generation, and is also beneficial for other engines in the fields in which a driving force is required and air-cooled engines mounted in two-wheeled vehicles and the like.

What is claimed is:

1. A general purpose engine comprising:

an engine main body;

an output shaft that outputs a rotation force of the engine main body;

a cooling fan that is rotated and driven by the output shaft;

a cooling cover that is fixed to the engine main body to define a cooling air passage which guides cooling air generated by the cooling fan along an exterior wall of the engine main body; and a temperature sensor that is fixed to the engine main body in a region away from the cooling air passage, wherein the cooling cover comprises an air inlet and an air outlet for guiding the cooling air and surrounds the engine main body, and the cooling air passage is configured to guide the cooling air introduced by the cooling fan from the air inlet to the air outlet while guiding the cooling air along the exterior wall of the engine main body, wherein the temperature sensor is disposed outside the cooling cover and fastened to the engine main body together with the cooling cover by a screw that defines the cooling air passage to the engine main body.

2. The general purpose engine according to claim 1, wherein the engine main body includes a boss part that projects from an exterior wall thereof, the cooling cover is fastened by the screw that is screwed into a screw hole of the boss part, and the temperature sensor is fastened to the boss part by the screw.

3. The general purpose engine according to claim 1, wherein the engine main body includes a boss part that projects from an exterior wall thereof, and the temperature sensor includes a male screw that is screwed into a screw hole of the boss part and an enlarged diameter part that is formed to have a larger diameter than the male screw, and is fastened to the boss part by clamping the cooling cover with the enlarged diameter part.

4. The general purpose engine according to claim 2, wherein the cooling cover is made of a resin material and includes a metallic collar that defines a through-hole, and the temperature sensor comes in contact with the collar and is fastened to the boss part.

5. The general purpose engine according to claim 2, wherein the boss part is integrally formed with the engine main body or formed separately and then connected to the engine main body.

6. The general purpose engine according to claim 1, wherein the engine includes an electronic control injector configured to inject a fuel toward an intake passage, and the temperature sensor is fixed to the engine main body in the vicinity of the injector.

7. The general purpose engine according to claim 1, wherein an outer case covering the whole thereof is provided outside the cooling cover, and the temperature sensor is located outside the cooling cover and disposed in a region covered with the outer case.

8. The general purpose engine according to claim 1, further comprising a power generation unit configured to generate power according to rotation of the output shaft.

9. The general purpose engine according to claim 1, further comprising:

an exhaust pipe defining an exhaust passage communicating with an exhaust port;

a power generation unit connecting to a crankshaft of the engine main body; and a recoil starter rotating the crankshaft through the cooling fan when an operator pulls a starting grip at the time of starting, wherein the cooling cover, formed of a metal plate comprising a stainless steel or a heat-resistant resin material, covers the engine main body, the exhaust pipe, the power generation unit, the cooling fan, and the recoil starter.

* * * * *